US005804271A

United States Patent [19]

Barry

[11] Patent Number: 5,804,271

[45] Date of Patent: Sep. 8, 1998

[54] SELF-ADHESIVE LABELS

[75] Inventor: David Robert Barry, St. Louis, Mo.

[73] Assignee: Inprint Systems, Inc., St. Charles, Mo.

[21] Appl. No.: 694,281

[22] Filed: Aug. 8, 1996

[51] Int. Cl.[6] ..... G09F 3/02

[52] U.S. Cl. ..... 428/40.1; 281/2; 281/5; 283/81; 428/41.7; 428/41.8; 428/42.1; 428/42.2; 428/42.3; 428/43; 428/192; 428/194; 428/914

[58] Field of Search ..... 428/40.1, 41.7, 428/41.8, 42.1, 42.2, 423, 43, 192, 194, 914; 283/81; 281/2, 5

[56] References Cited

U.S. PATENT DOCUMENTS 5,021,273 6/1991 Kobayashi ..... 428/42.1

5,399,403 3/1995 Instance ..... 428/41.8

*Primary Examiner*—Nasser Ahmad

*Attorney, Agent, or Firm*—Rothwell, Figg, Ernst & Kurz, P.C.

[57] ABSTRACT

A self-adhesive label comprising a self-adhesive base having a rear self-adhesive surface, a multipage booklet in an unfolded configuration disposed over a front surface of the base, a cover sheet disposed over the booklet and a self-adhesive laminar material having a rear self-adhesive surface which is adhered over the cover sheet and to a portion of the front surface of the base, the booklet being temporarily attached to the cover sheet whereby when the laminar material and the cover sheet are pulled away from the base thereby to reveal the booklet, the booklet is detachable from the cover sheet.

8 Claims, 1 Drawing Sheet

SELF-ADHESIVE LABELS

BACKGROUND TO THE INVENTION

The present invention relates to self-adhesive labels. In particular, the present invention relates to self-adhesive labels of multilaminar construction in which the label incorporates a booklet so as to provide a large surface area for carrying printed information which is greater than the surface area of the footprint of the label. The labels of the present invention have particular application in the labelling of agricultural chemicals such as herbicides and pesticides.

U.S. Pat. No. 5,399,403 in the name of David J. Instance discloses a self-adhesive label in which a booklet is adhered between an underlying self-adhesive support piece and an overlying self-adhesive laminar material. Such a label can encounter technical problems in use when the booklet is particularly thick and especially when the self-adhesive label is intended to be adhered to a rounded product, for example a cylindrical container. These problems result from stresses imparted to the laminar material, and in particular to an edge portion of the laminar material which is adhered to the product. This can cause the edge portion to become inadvertently detached from the product, thereby opening the label. The opened label can be accidentally torn or creased, which is clearly undesirable. The stresses can alternatively cause undesirable rucking of the label layers.

There is a need in the art for a booklet label, suitable for labelling agrochemicals, which can provide a removable booklet having a large number of pages yet which in the booklet label for a given number of pages, has a minimised thickness so as to avoid the stress problems discussed above and enables the maximum labelling area on a bottle surface to be utilised.

It is an aim of the present invention to provide an improved self-adhesive label which wholly or partially mitigates these problems.

SUMMARY OF THE INVENTION

The present invention provides a self-adhesive label comprising a self-adhesive base having a rear self-adhesive surface, a multipage booklet in an unfolded configuration disposed over a front surface of the base, a cover sheet disposed over the booklet and a self-adhesive laminar material having a rear self-adhesive surface which is adhered over the cover sheet and to a portion of the front surface of the base, the booklet being temporarily attached to the cover sheet whereby when the laminar material and the cover sheet are pulled away from the base thereby to reveal the booklet, the booklet is detachable from the cover sheet.

The present invention further provides a self-adhesive label carried on a backing of release material, the label comprising a bottom self-adhesive base, an intermediate integral unfolded booklet and cover sheet assembly which is disposed over the base, the booklet having a plurality of sheets which are stapled together by at least one staple and the at least one staple attaching the booklet to the cover sheet, and an upper self-adhesive transparent plastics overlaminate which is adhered over the cover sheet, is adhered to a portion of the base which is laterally adjacent one edge of the cover sheet thereby to adhere the integral booklet and the cover sheet assembly to the base and is adhered to the release material laterally adjacent an opposed edge of the cover sheet thereby to retain the label in a closed configuration.

The present invention yet further provides a self-adhesive label carried on a backing of release material, the label comprising an integral assembly of a multipage booklet in an unfolded configuration and a cover sheet disposed over the booklet, a binding of the booklet attaching the booklet to the cover sheet, and a self-adhesive laminar material having a rear self-adhesive surface which is adhered over the cover sheet and to a backing of release material, the binding being detachable from the cover sheet whereby when the laminar material is pulled away from the release material thereby to reveal the booklet, the booklet is detachable from the cover sheet which remains adhered to the laminar material.

BRIEF DESCRIPTION OF THE DRAWINGS

An embodiment of the present invention will now be described by way of example only, with reference to the accompanying drawings, in which.

DETAILED DESCRIPTION OF THE PREFERRED EMBODIMENT

Figure 1:
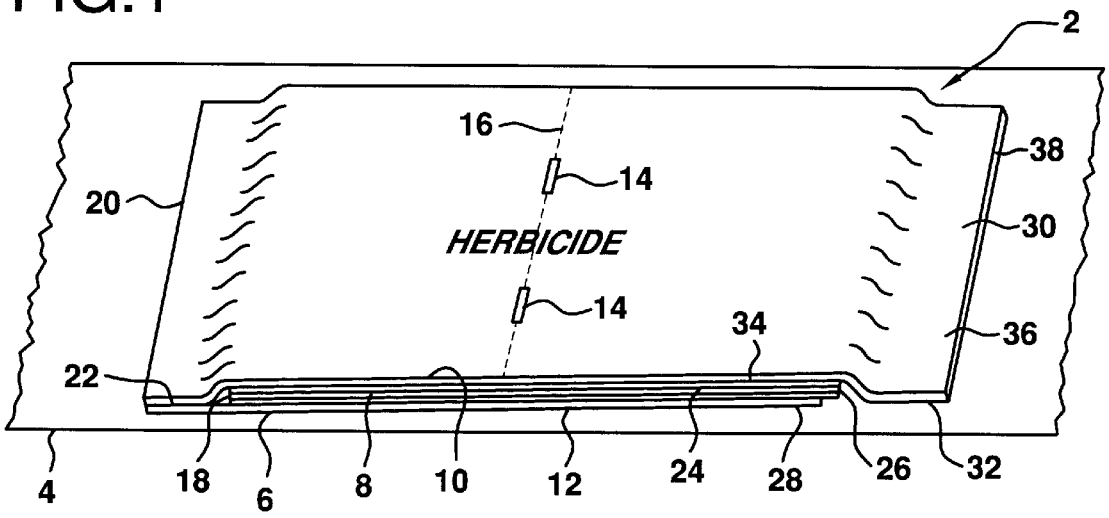
FIG. 1 is a perspective plan view of a self-adhesive label carried on a backing of release material in accordance with an embodiment of the present invention.

In the drawings, the thickness of some of the layers has been exaggerated for the purpose of clarity of illustration Referring to FIG. 1, there is shown a self-adhesive label 2 in accordance with an embodiment of the present invention when carried on a backing 4 of release material such as silicone-coated paper. Typically, a succession of such self-adhesive labels 2 is carried on an elongate web of the backing 4 of release material and the backing 4 of release material is wound into a reel in known manner for automatic application of the labels to a succession of products or containers to be labelled by a labelling machine.

The self-adhesive label 2 comprises a self-adhesive base 6, typically of paper or plastics which is coated on its rear surface with a layer of pressure-sensitive adhesive which is releasably adhered to the backing 4 of release material. An integral booklet 8 and cover sheet 10 assembly is disposed over a major portion 12 of the base 6. The booklet 8 comprises a plurality of unfolded sheets which are bound together by a binding which in the illustrated embodiment comprises a pair of staples 14. It will be apparent to the skilled person that any number of staples, for example only one staple 14, may be employed, or that other bindings such as stitching or adhesive, may be employed. The staples 14 are located substantially along a central transverse line 16 of the assembly as shown in phantom in FIG. 1, which line 16 corresponds to an ultimate spine of the booklet 8 following removal of the booklet 8 from the label 2 and subsequent folding. The staples 14 also temporarily attach the booklet 8 to the cover sheet 10 which covers the upper surface of the booklet 8. The staples 14 extend through the cover sheet 10 so as to be exposed along the substantially central line 16 on the upper surface of the cover sheet 10. At one transverse edge 18 of the integral booklet 8/cover sheet 10 assembly the assembly is longitudinally spaced from a transverse edge 20 of the label 2 thereby to expose a minor portion 22 of the front surface 24 of the base 6. At the opposed transverse edge 26 of the integral booklet 8/cover sheet 10 assembly, the transverse edge 26 extends transverse past an opposed transverse edge 28 of the base 6.

A self-adhesive transparent plastics overlaminate 30 is adhered by its self-adhesive surface 32 over the front surface 34 of the cover sheet 10 so as to cover the staples 14, to the portion 22 of the front surface 24 of the base 6 at the transverse edge 20 of the label 2 and directly to the backing 4 of release material at the opposed transverse edge 38 of the label 2 thereby forming an extended flap 36 of the overlaminate 30, which flap 36 holds the label 2 in a closed configuration. The front surface 34 of the cover sheet 10 is of course printed with information relating to the product to be labelled as are pages of the booklet 8 and the front surface 24 of the base 6. The cover sheet 10 extends past the base 6 towards the extended flap 36 so that when the label 2 is curved around a container, the extended flap 36 does not adhere to the base 6.

Figure 2:
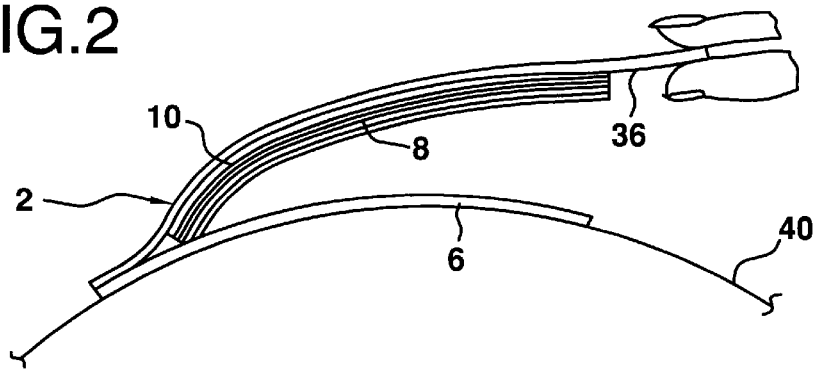
FIG. 2 is a side elevational view of the label of FIG. 1 when adhered to a cylindrical product and being manually opened.

Referring now to FIG. 2, the label 2 is shown when adhered by the self-adhesive base 6 to a product 40, the product typically being a container for liquid agrochemicals. In FIG. 2, the label 2 is shown in an opened configuration in which a user has manually pulled away from the container 40 the extended flap 36 of the overlaminate 30 which is adhered directly to the product 40 adjacent to the integral booklet 8/cover sheet 10 assembly. Such manual opening reveals the previously hidden booklet 8. The booklet 8 may be read in situ on the base 6 or detached from the self-adhesive label 2 by pulling whereby the staples 14 are pulled through the cover sheet 10 and are retained by the detached unfolded booklet 8. The cover sheet 10 remains adhered to the overlaminate 30. As a result of the relative strength of the plastics overlaminate compared to the cover sheet, the cover sheet is untorn (apart from at the locations where the staples are pulled through the cover sheet) and retains its integrity. When the extended flap 36 is again adhered to the container 40, the label is returned to its original appearance.

Figure 3:
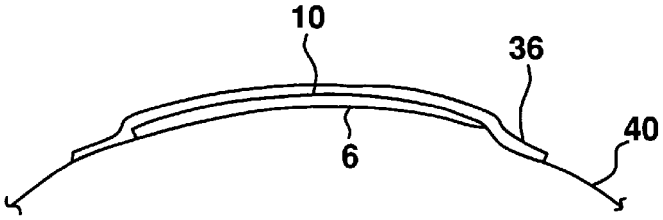
FIG. 3 is an elevational side view of the label of FIG. 2 following removal of the booklet of the label and re-adhesion of the laminar material to the product.
Figure 4:
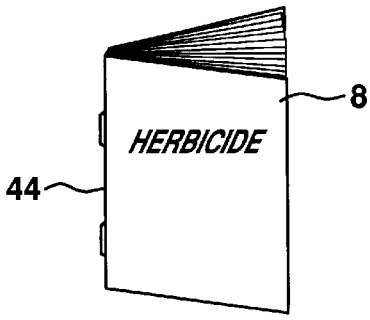
FIG. 4 is a perspective view of the booklet following removal from the self-adhesive label and folding.

As shown in FIGS. 3 and 4, the self-adhesive label 2 having had the booklet 8 removed therefrom may be returned to its closed configuration by re-adhering the extended flap 36 of the overlaminate 30 to the product 40. Thus despite the removal of the booklet 8, the same primary information is displayed by the label 2 in its closed configuration following removal of the booklet 8 because of the retention of the cover sheet 10 by the label 2. The booklet 8 may then be folded along the phantom line 16 so as to form a spine 44. The booklet 8 may then be read and retained by a user rather than throw the booklet away. The booklet 8 is preferably of a shape and dimensions so that it can fit into the user's shirt pocket This encourages the user to keep booklets for future reference. This is particularly important when the product which is labelled comprises hazardous liquids such as herbicides or pesticides.

The labels may be made generally by the method disclosed in U.S. Pat. No. 5,399,403, the disclosures of which are incorporated herein by reference. Thus a succession of booklet/cover sheet assemblies is applied to a succession of pre-die-cut self-adhesive labels carried on a release backing material. A web of self-adhesive overlaminate is laminated thereover and the required labels are formed by die-cutting through the overlaminate, the assemblies and the bases as far as the release backing material. The waste matrix is then stripped from the release material leaving a succession of labels of the invention on the length of release material which is then wound into a reel.

In an alterative embodiment, the transverse edge 28 of the base is extended whereby the transverse edges of the booklet/cover sheet assembly 10 and of the base 6 coincide.

The self-adhesive label of the present invention has a number of technical advantages over known labels. In the label of the present invention, the multipage booklet is held in the label in an unfolded configuration. For any given number of pages of the booklet, this reduces the thickness of the booklet which in turn is desirable in reducing the stress on the label when the label is adhered to a product, particularly a curved surface, which could lead to inadvertent opening of the label. Moreover, the booklet is initially securely yet detachably held in the label by the temporary attachment of the booklet to the cover sheet, Upon opening of the label, the booklet may readily be detached from the cover sheet and folded.

The labelling area of the booklet label for a given footprint of the label is maximised by permitting the unfolded booklet to use a maximum amount of the footprint, and for a given booklet size and number of pages this correspondingly can reduce the thickness of, the booklet. This is particularly important in the provision of a relatively small thick booklet which can fit into the shirt pocket of a user as aforesaid (i.e. the folded booklet is about the same size in plan as a packet of cigarettes).

It will be apparent to those skilled in the art that a number of modifications may be made to the self-adhesive labels disclosed herein without departing from the present invention. For example, the self-adhesive base may be omitted or alternatively the entire rear surface of the label may be defined by a self-adhesive base. In a further modification, the extended flap of the overlaminate may be provided with a peel-up tab in one corner thereof, the tab being provided by an extended corner part of the cover sheet.

I claim:

1. A self-adhesive label comprising a self-adhesive base having a rear self-adhesive surface, a multipage booklet in an unfolded configuration disposed over a front surface of the base, the booklet having a substantially central binding, a cover sheet disposed over the booklet and a self-adhesive laminar material having a rear self-adhesive surface which is adhered over the cover sheet and to a portion of the front surface of the base, the booklet being temporarily attached to the cover sheet by the binding whereby when the laminar material and the cover sheet are pulled away from the base thereby to reveal the booklet, the booklet is detachable from the cover sheet.

2. A self-adhesive label according to claim 1 wherein the binding comprises at least one staple.

3. A self-adhesive label according to claim 1 wherein the label is releasably adhered to a backing of release material and an extended flap of the laminar material is directly adhered to the release material at a first edge of the label opposite to a second edge of the label at which the said portion of the front surface of the base is located.

4. A self-adhesive label according to claim 3 wherein the cover sheet extends past the base in a direction towards said first side of the label.

5. A self-adhesive label carried on a backing of release material, the label comprising a bottom self-adhesive base, an intermediate integral unfolded booklet and cover sheet assembly which is disposed over the base, the booklet having a plurality of sheets which are stapled together by at least one staple along a substantially central line of the booklet and the at least one staple attaching the booklet to the cover sheet, and an upper self-adhesive transparent plastics overlaminate which is adhered over the cover sheet, is adhered to a portion of the base which is laterally adjacent one edge of the cover sheet thereby to adhere the integral booklet and the cover sheet assembly to the base and is directly adhered to the release material laterally adjacent an opposed edge of the cover sheet thereby to retain the label in a closed configuration.

6. A self-adhesive label carried on a backing of release material, the label comprising an integral assembly of a multipage booklet in an unfolded configuration and a cover sheet disposed over the booklet, a substanially central binding of the booklet attaching the booklet to the cover sheet, and a self-adhesive laminar material having a rear self-adhesive surface which is adhered over the cover sheet and to a backing of release material, the binding being detachable from the cover sheet whereby when the laminar material is pulled away from the release material thereby to reveal the booklet, the booklet is detachable from the cover sheet which remains adhered to the laminar material.

7. A self-adhesive label according to claim 6 wherein the binding comprises at least one staple.

8. A self-adhesive label according to claim 6 further comprising a self-adhesive base of the label over which the booklet is disposed and to a front surface of which the laminar material is adhered, the base being releasably adhered to the backing of release material.

* * * * *